US007044425B2

(12) United States Patent
Jones et al.

(10) Patent No.: US 7,044,425 B2
(45) **Date of Patent: *May 16, 2006**

(54) INTEGRATED KEYBOARD PLATFORM AND DOCUMENT SUPPORT

(75) Inventors: David K. Jones, Grand Rapids, MI (US); Joseph D. Ruedinger, Grand Haven, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/981,149

(22) Filed: Nov. 4, 2004

(65) Prior Publication Data

US 2005/0061942 A1 Mar. 24, 2005

Related U.S. Application Data

(63) Continuation of application No. 09/563,089, filed on May 2, 2000, now Pat. No. 6,877,707.

(51) Int. Cl.
*B41J 11/02* (2006.01)

(52) U.S. Cl. ..... 248/442.2; 248/441.2; 248/450; 248/118; 248/276.1; 248/918

(58) Field of Classification Search ..... 248/441.2, 248/450, 118, 276.1, 918, 441.1, 442.2; 108/50.01, 25

See application file for complete search history.

(56) References Cited

U.S. PATENT DOCUMENTS

| | | | | |
|---|---|---|---|---|
| 363,142 | A | 5/1887 | Horton | 248/443 |
| 560,465 | A | 5/1896 | Bostwick | 248/453 |
| D33,849 | S | 1/1901 | Meyer | 248/441.1 |
| 1,006,334 | A | 10/1911 | Wright | 248/473 |
| 1,681,586 | A * | 8/1928 | Kessler | 248/473 |
| 1,704,561 | A | 3/1929 | Egan | 248/453 |
| 1,719,503 | A | 7/1929 | Egan | 248/453 |
| 1,841,690 | A | 1/1932 | Weindel, Jr. | 248/453 |
| 2,117,668 | A | 5/1938 | Johnson | 248/453 |
| 2,640,747 | A | 6/1953 | Bodenhoff | 248/444 |
| D183,947 | S | 11/1958 | Quistgaard | D7/673 |
| 3,073,056 | A | 1/1963 | Russell | 248/451 |
| 3,272,183 | A | 9/1966 | Craighead et al. | 248/451 |
| 3,361,131 | A | 1/1968 | Barger | 248/454 |
| 3,779,504 | A | 12/1973 | Schwartz et al. | 248/441 |
| D246,062 | S | 10/1977 | Kowalski | D21/392 |
| 4,125,243 | A | 11/1978 | Liptak | 248/473 |
| 4,204,598 | A | 5/1980 | Adams | 248/152 |
| 4,291,882 | A | 9/1981 | Del Monte | 273/148 A |
| 4,313,112 | A | 1/1982 | Foster | 248/442.2 |

(Continued)

*Primary Examiner*—Robert P. Olszewski
*Assistant Examiner*—Todd M. Epps
(74) *Attorney, Agent, or Firm*—Price, Heneveld, Cooper, DeWitt & Litton, LLP

(57) ABSTRACT

An integrated keyboard platform and document support includes a base and a keyboard support member having an upper surface. The keyboard support member is movably mounted to the base to provide adjustment through a plurality of positions of the keyboard support member. An integral document holder includes a groove having a curved shape in plan view and located in the upper surface of the keyboard support member. The groove defines an engagement surface engagable with a bottom edge of the document and defining a plane of engagement. The plane of engagement is disposed at a non-zero angle relative to the support surface, and is inclined substantially level or rearwardly downward throughout the plurality of positions whereby a document may be held substantially vertical or inclined rearwardly in the curved groove throughout the plurality of positions.

21 Claims, 3 Drawing Sheets

U.S. PATENT DOCUMENTS

D271,895 S 12/1983 Runions ..... D21/392
D272,547 S 2/1984 Gordon ..... D19/91
D273,961 S 5/1984 Bassey ..... D6/457
D274,919 S 7/1984 Basaldua, Jr. ..... D19/75
4,475,705 A 10/1984 Henneberg et al. ..... 248/442.2
4,494,755 A 1/1985 Caillouet, Jr. ..... 200/330
4,546,947 A 10/1985 Gesten ..... 248/442.2
D281,384 S 11/1985 Lacey ..... D7/698
4,635,893 A 1/1987 Nelson ..... 248/558
4,645,163 A 2/1987 Zovar ..... 248/452
4,685,647 A 8/1987 Calhoun ..... 248/444.1
D294,209 S 2/1988 Havelka ..... D6/467
4,807,538 A 2/1989 Hoffman ..... 108/25
4,836,489 A 6/1989 Chu ..... 248/442.2
4,840,361 A 6/1989 Richter ..... 269/289 R
D303,126 S 8/1989 Rossow ..... D19/91
4,863,124 A 9/1989 Ball et al. ..... 248/458
4,893,775 A 1/1990 Long ..... 248/442.2
D306,529 S 3/1990 Goodell ..... D6/310
D314,565 S 2/1991 Davis et al. ..... D14/114
D314,566 S 2/1991 Davis et al. ..... D14/114
D316,115 S 4/1991 Davis et al. ..... D19/91
D320,198 S 9/1991 Ward ..... D14/114
5,067,681 A 11/1991 Huang et al. ..... 248/442.2
5,074,511 A 12/1991 Wilson ..... 248/346
5,081,936 A 1/1992 Drieling ..... 248/444
5,104,086 A 4/1992 Ramey, III. et al. ..... 248/442.2
D328,923 S 8/1992 Tu ..... D19/96
5,136,787 A 8/1992 Phills ..... 33/483
5,144,303 A 9/1992 Purcell ..... 341/22
5,144,763 A 9/1992 Calhoun ..... 40/506
5,161,767 A 11/1992 Hansen ..... 248/442.2
D333,723 S 3/1993 Risner ..... D3/23
D333,819 S 3/1993 Toney ..... D14/162
5,211,367 A * 5/1993 Musculus ..... 248/279.1
5,264,995 A 11/1993 McKee ..... 362/161
5,292,099 A 3/1994 Isham et al. ..... 248/442.2
5,301,915 A 4/1994 Bahniuk et al. ..... 248/452
D348,374 S 7/1994 Dandurand ..... D7/698
5,328,145 A 7/1994 Charapich ..... 248/442.2
5,341,929 A 8/1994 Stefancin, Jr. ..... 248/442.2
D350,374 S 9/1994 Comeau ..... D19/90
5,347,738 A 9/1994 Zweig et al. ..... 40/642
5,383,643 A 1/1995 Koch ..... 248/442.2
5,398,905 A 3/1995 Hinson ..... 248/442.2
D357,008 S 4/1995 Pohlman ..... D14/448
D357,705 S 4/1995 Milojevich ..... D19/90
D366,064 S 1/1996 Milojevich ..... D19/90
D366,675 S 1/1996 Milojevich ..... D19/90
5,497,970 A 3/1996 Pursell, Jr. ..... 248/442.2
5,499,793 A 3/1996 Salansky ..... 248/442.2
5,505,421 A 4/1996 Marthaler ..... 248/442.2
D369,473 S 5/1996 Gluck ..... D6/300
5,533,702 A 7/1996 Koch ..... 248/442.2
5,535,682 A 7/1996 Aigeldinger ..... 108/25
5,618,020 A 4/1997 Hegarty et al. ..... 248/442.2
D379,374 S 5/1997 Mason, III ..... D20/10
5,626,323 A 5/1997 Lechman et al. ..... 248/286.1
5,636,822 A 6/1997 Hendershot et al. ... 248/346.01
5,651,524 A 7/1997 Calfee ..... 248/442.2
D382,017 S 8/1997 Bohr et al. ..... D20/10
D383,122 S 9/1997 Parks ..... D19/91
5,678,792 A 10/1997 Arguin et al. ..... 248/205.1
D386,532 S 11/1997 Bass ..... D20/40
5,735,222 A 4/1998 Webb ..... 248/91
D395,554 S 6/1998 Perkins, Jr. ..... D6/300
D396,309 S 7/1998 Churchville et al. ..... D26/10
5,775,663 A 7/1998 Fitzsimmons et al. ..... 248/450
5,786,861 A 7/1998 Parker ..... 248/442.2
5,806,693 A 9/1998 Carbonaro ..... 248/205.3
5,845,586 A * 12/1998 Moore ..... 108/50.01
5,857,654 A 1/1999 Berman ..... 248/441.1
5,890,603 A 4/1999 Arguin et al. ..... 248/442.2
5,901,937 A 5/1999 Compeau et al. ..... 248/442.2
5,908,002 A 6/1999 Alexander et al. ..... 108/50.11
5,921,521 A * 7/1999 Fitzsimmons et al. ..... 248/450
5,992,810 A 11/1999 Crinion et al. ..... 248/284.1
6,032,913 A 3/2000 Dawson ..... 248/346.01
6,058,851 A * 5/2000 Alexander et al. ..... 108/25
6,059,249 A 5/2000 Scatterday ..... 248/450
6,079,676 A 6/2000 Hackett et al. ..... 248/118
6,109,585 A 8/2000 Burch, Jr. ..... 248/442.2
6,244,547 B1 * 6/2001 Tonizzo et al. ..... 248/118.3
6,279,859 B1 8/2001 West et al. ..... 248/118
6,311,940 B1 11/2001 Koshimizu ..... 248/176.1
6,322,031 B1 11/2001 LeClair et al. ..... 248/286.1
6,349,915 B1 2/2002 Jones et al. ..... 248/442.2
6,497,391 B1 12/2002 Timm ..... 248/118
6,877,707 B1 * 4/2005 Jones et al. ..... 248/442.2
2002/0179781 A1 12/2002 Timm ..... 248/118

* cited by examiner

INTEGRATED KEYBOARD PLATFORM AND DOCUMENT SUPPORT

CROSS-REFERENCE TO RELATED APPLICATIONS

The present application is a continuation of U.S. patent application Ser. No. 09/563,089, filed on May 2, 2000, issued U.S. Pat. No. 6,877,707, the entire contents of which are incorporated by reference.

BACKGROUND OF THE INVENTION

The present invention relates to keyboard supports for computer keyboards and the like, and in particular to an integrated keyboard support platform and document support.

Personal computers are becoming more common in many industry and office environments. Such systems may employ a keypad, mouse, and/or other data input devices, such as a digitizing pad. Often, the personal computer occupies much of the desk or worksurface, making it difficult to locate the keyboard thereon. Furthermore, many users do not prefer to locate the keyboard on the desktop because it is uncomfortable to address the keyboard over the course of the workday. A number of devices have been developed to offer greater flexibility in supporting the keyboard, mouse, or other user interface devices at a comfortable position relative to the user. Available keyboard support assemblies include a keyboard support surface that is permanently attached to a height adjustment device. Such height adjustment devices may be capable of positioning the keyboard support surface below the worksurface during use and/or for storage. Various keyboard support configurations have been developed, and may include a hand support, a mouse support, or a specific keyboard clamping arrangement.

During operation of the computer, an operator may need to read a document for entry of the information from the document. Various document holders or "copy stands" have been developed for this purpose. However, such holders are generally designed to be placed on a worksurface adjacent the user. Accordingly, such supports obstruct the worksurface, and also may be difficult to position in a comfortable line of sight for the user.

Accordingly, a device alleviating the above-identified drawbacks of existing devices is desired.

SUMMARY OF THE INVENTION

One aspect of the present invention is to provide an integrated keyboard platform and document support. The keyboard support includes a base and a keyboard support member having an upper surface. The keyboard support member is movably mounted to the base to provide adjustment through a plurality of positions of the keyboard support member. An integral document holder includes a groove having a curved shape in plan view and located in the upper surface of the keyboard support member. The groove defines an engagement surface engagable with a bottom edge of the document and defining a plane of engagement. The plane of engagement is disposed at a non-zero angle relative to the support surface, and is inclined substantially level or rearwardly downward throughout the plurality of positions such that a document may be held substantially vertical or inclined rearwardly in the curved groove throughout the plurality of positions.

Another aspect of the present invention is a repositionable keyboard support including a keyboard support defining a keyboard support surface, wherein at least a portion of the support surface is planar. A document holder on the support surface has a minimal height whereby at least a portion of the keyboard support including the document holder is positionable below and proximate a worksurface to provide adequate clearance for a conventional computer keyboard without requiring additional clearance for the document holder.

Yet another aspect of the present invention is a keyboard support including a base and a keyboard support member having a planar upper surface. An articulating support arm movably interconnects the base and the keyboard support member. The keyboard support also includes an upwardly opening curved groove in the upper surface of the keyboard support member for holding documents in a generally upright position on the keyboard support member.

These and other features, advantages, and objects of the present invention will be further understood and appreciated by those skilled in the art by reference to the following specification, claims, and appended drawings.

BRIEF DESCRIPTION OF THE DRAWINGS

FIG. 2;

FIG. 2;

FIG. 2;

DETAILED DESCRIPTION OF PREFERRED EMBODIMENT

Figure 1:
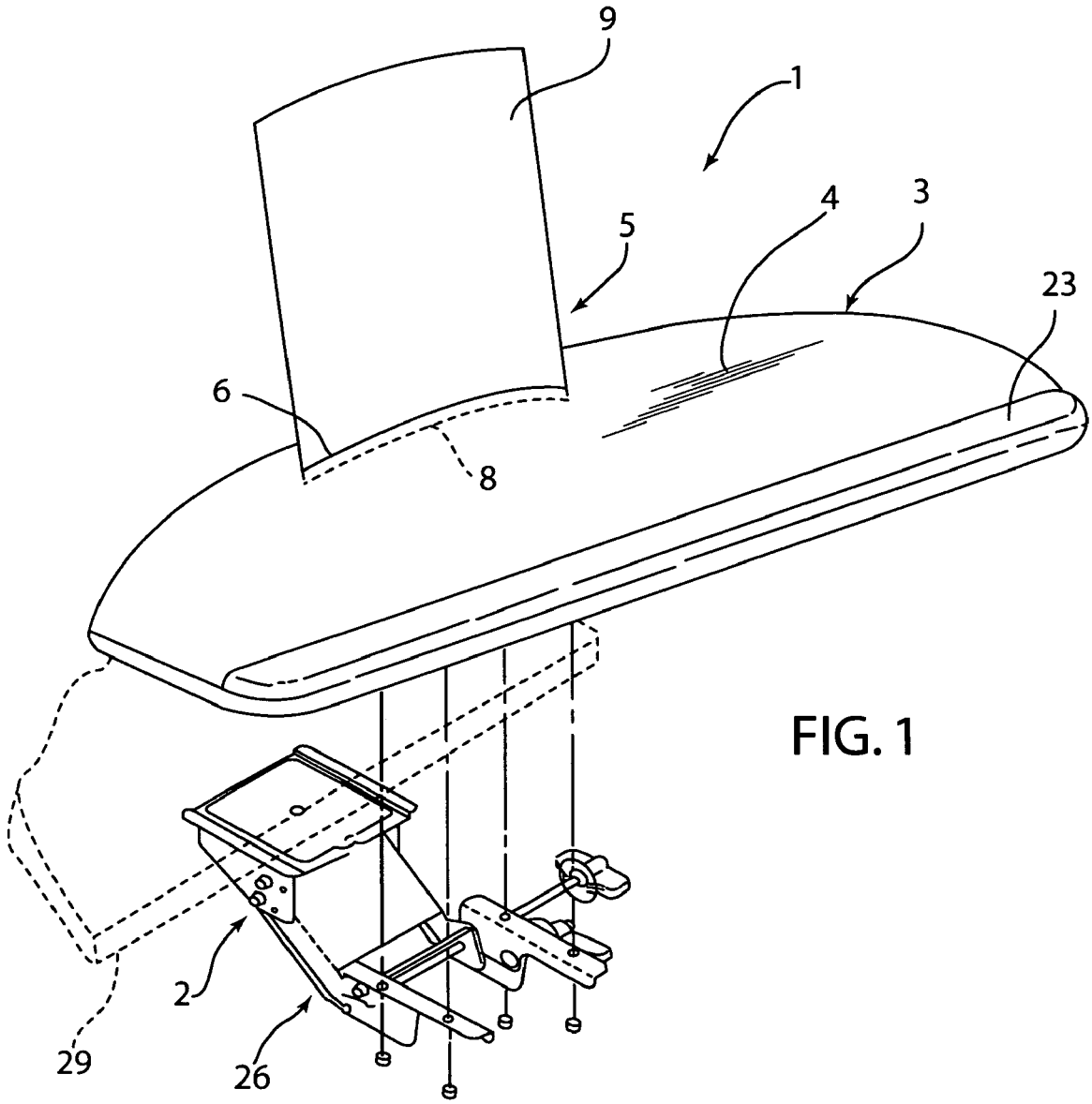
FIG. 1 is an exploded perspective view of the integrated keyboard platform and document support of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
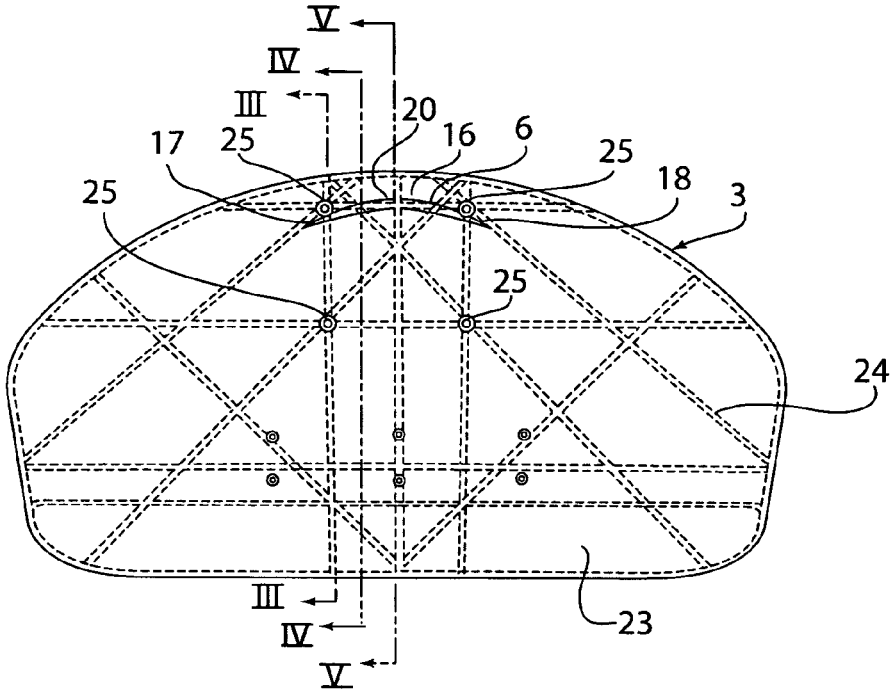
FIG. 2 is a top plan view of the integrated keyboard platform and document support of the FIG. 1.
Figure 3:
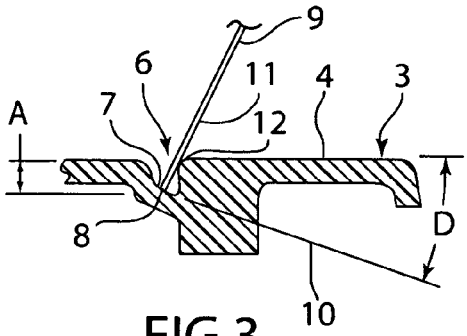
FIG. 3 is a fragmentary, cross-sectional view taken along the line III—III.
Figure 4:
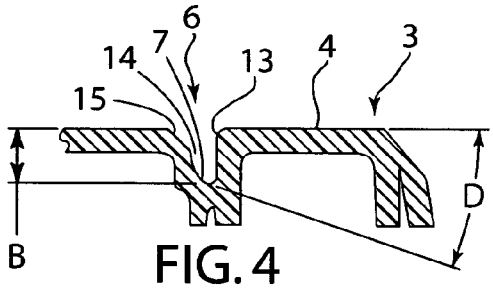
FIG. 4 is a fragmentary, cross-sectional view taken along the line IV—IV.

The reference numeral 1 (FIG. 1) generally designates an integrated keyboard platform and document support embodying the present invention, which is particularly designed for use in offices, and other similar settings and environments. In the illustrated example, the keyboard platform includes a base 2 and a keyboard support member 3 having an upper surface 4. The keyboard support member 3 is movably mounted to the base 2 to provide adjustment through a plurality of positions of the keyboard support member 3. An integral document holder 5 includes a groove 6 having a curved shape in plan view, and located in the upper surface 4 of the keyboard support member 3. With further reference to FIGS. 2–4, the groove 6 defines an engagement or base surface 7 engagable with a bottom edge 8 of a document 9. The engagement surface defines a plane of engagement 10 disposed at a non-zero angle relative to the support surface 4 and inclined substantially level or rearwardly downward throughout the plurality of positions of the keyboard support member 3 whereby the document 9 may be held substantially vertical or inclined rearwardly in the curved groove throughout the plurality of positions.

Figure 5:
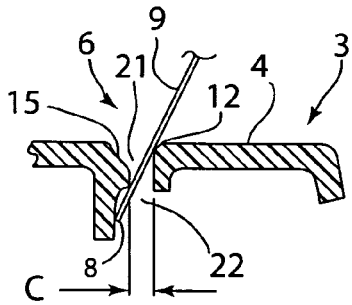
FIG. 5 is a fragmentary, cross-sectional view taken along the line V—V.

As best seen in FIG. 3, the base surface 7 forms an angle "D" with the upper surface 4. The angle D is preferably about twenty degrees, but may fall within the range of about fifteen degrees to about twenty-five degrees. Further, wider ranges of angles, such as, for example, ten degrees to thirty degrees may also be utilized to position the document 9. Because the angle D is non-zero, document 9 will be supported at a rearwardly inclined angle, with the bottom edge 8 of document 9 contacting the base surface 7. Rear surface 11 of document 9 contacts the corner 12 of groove 6. Groove 6 has a generally U-shaped cross section formed by base surface 7, upwardly-extending rear face 13, and upwardly extending front face 14. The chamfer 15 at the top edge of front face 14 helps to guide the document 9 during insertion of the document 9 in groove 6. Because the document 9 angles rearwardly, groove 6 is deeper adjacent the central portion 16 than at the ends 17 and 18. For example, the dimension "A" of FIG. 3 corresponds to the depth of groove 6 adjacent the end 17 of groove 6, and the dimension "B" of FIG. 4 corresponds to the depth of groove 6 adjacent the central portion 16 thereof. In the illustrated example, dimension A is 0.184 inches, and dimension B is 0.290 inches. As best seen in FIG. 5, groove 6 has an opening 21 through base surface 7 at the center 20 of groove 6. In the illustrated example, the opening 21 has a dimension "C" of about 0.12 inches. The document 9 contacts corner 12 adjacent opening 21 as described above, and also contacts a lower corner 22 when the document 9 is received in opening 21. The contact of document 9 on corners 12 and 22 adjacent the center 20 of groove 6 further stabilizes and supports the document 9 in the desired angular position.

Figure 6:
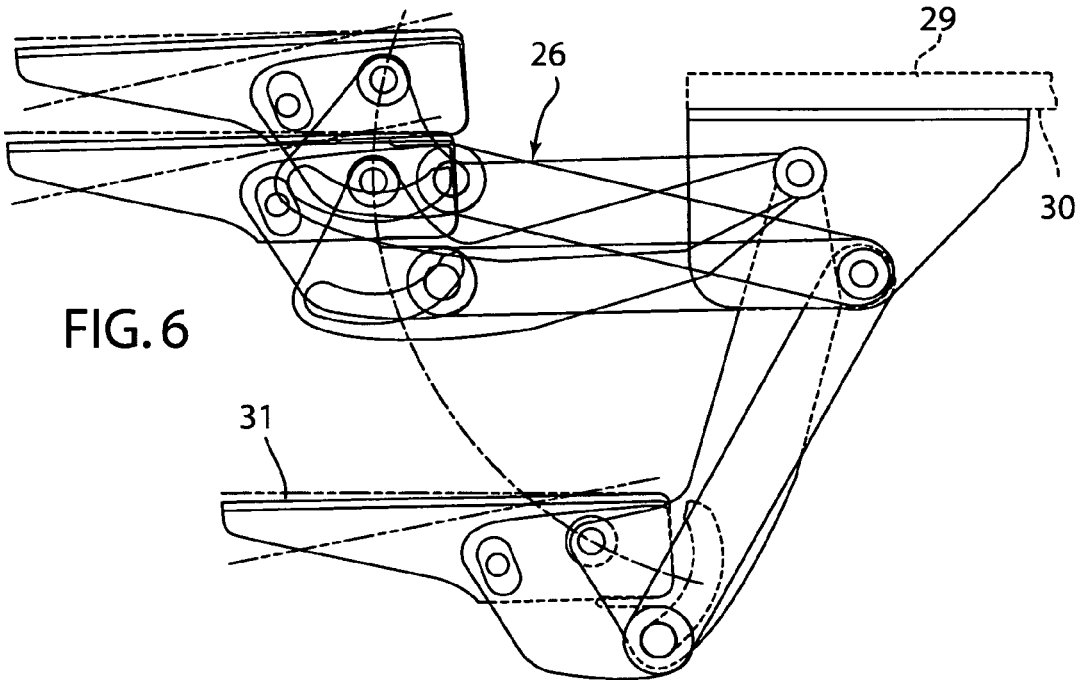
FIG. 6 is a side elevational view of a first type of articulating support arm that can be used to mount the integrated keyboard platform and document support of FIG. 1 to an associated worksurface.
Figure 7:
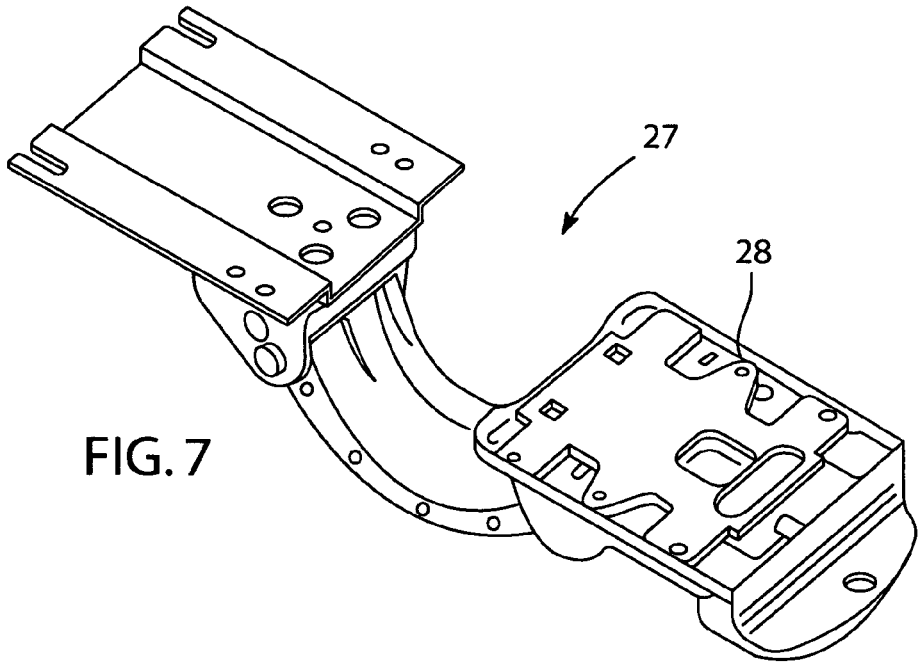
FIG. 7 is a perspective view of a second type of articulating support arm that may be used to mount the integrated keyboard platform and document support of FIG. 1 to an associated worksurface.

Keyboard support member 3 preferably includes a wrist rest 23 to support a user's wrist and hand area during use. Keyboard support member 3 is preferably made of a suitable polymer material, and includes a plurality of reinforcing ribs 24, as well as connectors 25. Keyboard support member 3 may also be made of wood or other material, and the groove 6 may be milled, routed, or otherwise machined into the upper surface 4 of the keyboard support member 3. Connectors 25 may be a standard threaded bolt or stud for securing keyboard support member 3 to an articulating support arm 26. Alternately, non-threaded quick-disconnect connectors may be utilized to connect keyboard support member 3 to a selected one of various articulating support arms. A quick-disconnect arrangement is described in detail in U.S. Pat. No. 6,135,405, the entire contents of which is hereby incorporated herein by reference. Connectors 25 may be an adapter having an annular groove, such as disclosed in above-identified U.S. Pat. No. 6,135,405. Examples of different types of articulating support arms that can be interchangeably connected to keyboard support member 3 are illustrated in FIGS. 6 and 7. Articulating support arm 26 of FIG. 6 is substantially the same as the articulating arm 26 illustrated in FIG. 1, and can be mounted to the lower surface 30 of a worksurface 29. The keyboard support member 3 can be secured to the end portion 31 of articulating support arm 26 utilizing either conventional threaded fasteners or a quick-disconnect connector assembly, such as that disclosed in above-identified U.S. Pat. No. 6,135,405. The keyboard support member 3 may also be connected to a second type of articulating support arm 27 by either a conventional threaded fastener arrangement, or the quick-disconnect connector assembly 28. Quick-disconnect connector assembly 28 is substantially identical to that disclosed in above-identified U.S. Pat. No. 6,135,405. Various articulating support arm designs having a standardized connector arrangement that is compatible with the connectors 25 of keyboard support member 3 may be utilized. This arrangement permits the keyboard support member 3 to be connected to a selected one of a variety of different types of articulating support arms as desired for a particular application.

Because the document holder 5 including groove 6 has a low profile that does not extend upwardly above a keyboard (not shown) positioned on surface 4 of keyboard support member 3, the keyboard support member 3 may be stored in a position directly below the worksurface 29 without requiring adjustment of the vertical position of keyboard support member 3 to account for the document support. When positioned below worksurface 29, keyboard support member 3 can be positioned parallel to, or tilted slightly, relative to worksurface 29. In this position keyboard support member 3 does not interfere with the legs of a seated user. The document support does not protrude upwardly above the surface 4 of keyboard support member 3, providing a very low profile such that upper surface 4 can be positioned very close to the lower surface of worksurface 29. Also, during use, the document holder 6 is conveniently positioned directly in front of a user, thereby reducing the effort required of an operator reading the document and inputting the data or other information utilizing the computer keyboard. Because the document holder 5 is positioned on the keyboard support member 3, the worksurface is not cluttered or otherwise obstructed as with conventional document holders that rest on the worksurface itself.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An integrated keyboard platform and document support comprising:

a base;

a keyboard support member made of a polymer material and having an upper surface, at least a portion thereof being adapted to support a keyboard, said keyboard support member movably mounted to said base to provide adjustment through a plurality of positions of said keyboard support member, the keyboard support member including a wrist rest having an upper support surface spaced above the upper surface of the keyboard support member; and an integral document holder including a groove having a curved shape in plan view and located in said upper surface of said keyboard support member, said groove defining an engagement surface engagable with a bottom edge of the document and defining a plane of engagement, said plane of engagement disposed at a non-zero angle relative to said support surface and inclined substantially level or rearwardly downward whereby a document may be held substantially vertical or inclined rearwardly in said curved groove.

2. The keyboard platform and document support set forth in claim 1, wherein:

said groove defines a base surface along at least a portion thereof, and a pair of spaced-apart side surfaces along at least a portion of said groove, said base surface forming an angle with said upper surface sufficient to prevent a document positioned in said groove from becoming vertical as said keyboard support member is moved through said rotational range.

3. The keyboard platform and document support set forth in claim 2, wherein:

said base surface forms an angle in the range of fifteen to twenty-five degrees with said upper surface.

4. The keyboard platform and document support set forth in claim 3, wherein:

said angle is about twenty degrees.

5. The keyboard platform and document support set forth in claim 1, wherein:

at least a portion of said upper surface of said keyboard support member is planar;

said groove defines ends and a central portion between said ends having a greater depth relative to said planar upper surface than a depth adjacent said ends.

6. The keyboard platform and document support set forth in claim 5, wherein:

said base surface has an opening therethrough for receiving a lower edge of a sheet of paper positioned in said groove.

7. The keyboard platform and document support set forth in claim 1, wherein:

said groove defines a constant radius in plan view.

8. The keyboard platform and document support set forth in claim 1, wherein:

said keyboard support member is free from upwardly-extending protrusions to provide unimpeded positioning of said keyboard support member below and proximate a worksurface to provide adequate clearance for a conventional computer keyboard without requiring additional clearance for said document holder.

9. The keyboard platform and document support set forth in claim 1, wherein:

said upper surface has a generally planar forward portion shaped to support a keyboard, said upper surface having a rear portion that is not covered by a conventional computer keyboard positioned on said forward portion of said upper surface, said groove located in said rear portion of said upper surface.

10. A repositionable keyboard support, comprising:

a keyboard support defining an upper surface, at least a portion thereof being configured to support a keyboard; and a document holder comprising a curved groove in a rear portion of said upper surface having a minimal height whereby at least a portion of said keyboard support including said document holder is positionable below and proximate a worksurface to provide adequate clearance for a conventional computer keyboard without requiring additional clearance for said document holder.

11. The keyboard support set forth in claim 10, wherein:

said document holder is made of a polymer material.

12. The keyboard support set forth in claim 10, wherein:

said groove has an arcuate shape in plan view.

13. The keyboard support set forth in claim 12, wherein:

said groove has a generally U-shaped cross sectional shape defined by a base surface and spaced-apart front and rear faces that extend upwardly from said base surface, said base surface forming an angle greater than zero with said planar forward portion of said support surface.

14. The keyboard support set forth in claim 13, wherein:

said groove defines a central portion and opposite ends, said central portion defining a greater depth relative to said support surface than said opposite ends.

15. The keyboard support set forth in claim 14, wherein:

said front face of said groove has an upper edge which includes a chamfered portion.

16. The keyboard support set forth in claim 15, wherein:

said base surface has an opening therethrough shaped to permit the lower edge of a document to extend through said opening.

17. A keyboard support, comprising:

a base;

a keyboard support member having an upper surface, at least a portion of which is adapted to support a keyboard;

an articulating support arm movably interconnecting said base and said keyboard support member;

an upwardly opening curved groove in a rear portion of said upper surface for holding documents in a generally upright position on said keyboard support member.

18. The keyboard support set forth in claim 17, wherein:

said curved groove has a generally U-shaped cross section defined by a base surface and upwardly-extending side faces, at least a portion of said base surface forming an angle with said planar upper surface in the range of about ten to thirty degrees.

19. The keyboard support set forth in claim 18, wherein:

said keyboard support member defines a forward edge and a rearward edge, said groove formed adjacent said rearward edge in a rear portion of said keyboard support member, said rear portion having a low profile with a height no higher than a conventional computer keyboard to permit positioning of said keyboard support member immediately below a worksurface to provide clearance for a seated user.

20. The keyboard support set forth in claim 17, wherein:

said groove defines a central portion and opposite ends, said base surface having a greater depth relative to said planar upper surface at said central portion than at said opposite ends.

21. The keyboard support set forth in claim 17, wherein:

said groove has an arcuate shape in plan view.

* * * * *